United States Patent [19]

Hemingsley

[11] 4,325,514

[45] Apr. 20, 1982

[54] COMMINUTION OF MINERALS

[75] Inventor: Herbert Hemingsley, Marina-di-Carrara, Italy

[73] Assignee: English Clays Lovering Pochin & Company Limited, St. Austell, England

[21] Appl. No.: 73,880

[22] Filed: Sep. 10, 1979

Related U.S. Application Data

[63] Continuation of Ser. No. 880,875, is a continuation-in-part of Ser. No. 747,107, Dec. 3, 1976, abandoned.

[30] Foreign Application Priority Data

Dec. 5, 1975 [GB] United Kingdom ..... 50112/75

[51] Int. Cl.[3] ..... B02C 25/00

[52] U.S. Cl. ..... 241/16; 241/21; 241/26; 241/29; 241/35; 241/46.17; 241/152 R; 241/284

[58] Field of Search ..... 241/16, 29, 30, 35, 241/36, 43, 62, 46 R, 21, 46.02, 154, 46.08, 46.11, 46.17, 284, 26, 152 R, 101 D

[56] References Cited

U.S. PATENT DOCUMENTS 2,613,878 10/1952 Hailey .
3,417,927 12/1968 Crocker et al. ..... 241/35 X
3,534,911 10/1970 Gwilliam ..... 241/16
3,604,634 9/1971 Windle ..... 241/16
3,989,195 11/1976 Falcon-Steward .
3,995,817 12/1976 Brociner ..... 214/30

FOREIGN PATENT DOCUMENTS 1414964 11/1975 United Kingdom .

*Primary Examiner*—Mark Rosenbaum
*Attorney, Agent, or Firm*—Browdy and Neimark

[57] ABSTRACT

A method of comminuting a mineral involves introducing into a grinding chamber which has an internal, rotatable impeller driven by an electric motor, water, a dispersing agent and pieces of said mineral not larger than 20 mm to form a slurry. The slurry is agitated in the grinding chamber and a slurry of comminuted minerals is continuously withdrawn from the grinding chamber. The rates of introducing the water, the dispersing agent and the pieces of mineral into the grinding chamber and the rate of withdrawing the slurry of comminuted mineral from the grinding chamber are such that the slurry of comminuted mineral withdrawn from the grinding chamber contains at least 50% by weight of solids. The volume of material in the grinding chamber is maintained substantially constant, and the power consumed by the electric motor driving the impeller is maintained between upper and lower limits.

6 Claims, 2 Drawing Figures

COMMINUTION OF MINERALS

CROSS REFERENCE TO RELATED APPLICATIONS

This application is a continuation of Ser. No. 880,875, filed Feb. 22, 1978, now abandoned, which in turn was a continuation-in-part of application Ser. No. 747,107 filed Dec. 3, 1976, now abandoned.

BACKGROUND OF THE INVENTION

This invention relates to the comminution of minerals and, more particularly, but not exclusively, is concerned with the comminution of the harder varieties of natural calcium carbonate such as calcite marble, vein calcite, dolomite and limestone, in order to provide fine particulate calcium carbonate suitable for use as a pigment or filler material.

Conventionally the harder types of calcium carbonate are quarried by blasting and the large lumps of rock thus liberated are broken down in heavy duty crushers. The final product of the crushing plant is generally chippings having a maximum particle size of about 20 mm. These chippings are then further reduced in size by milling in a ball mill charged with a suitable grinding medium which may conveniently be flint pebbles having diameters of about 50–100 mm although other grinding media may equally well be used. The ball milling step may be performed wet or dry but when the product is required to be comminuted further it is preferred to grind the chippings in the form of an aqueous slurry.

The ball mills conventionally used have the disadvantages that their capital cost is high and that the amount of energy which can be brought to bear on the feed material is governed by the weight of the grinding medium and the maximum distance through which they can fall under gravity which is generally a little less than the internal diameter of the mill. For this reason the grinding efficiency of a ball mill, measured in terms of the weight of feed per hour which can be reduced to a given particle size, tends to be rather low. In addition, the cost of maintaining a conventional ball mill may be high because it is supported at each end in heavy roller or ball bearings which are subject to wear and must be renovated at frequent intervals. Also, while grinding the feed, the grinding balls or pebbles themselves become abraded or fractured to some extent and the product may therefore become contaminated with the material of which the pebbles or balls are constituted.

SUMMARY OF THE INVENTION

According to the present invention there is provided a method of comminuting a mineral, which comprises the following steps:

(i) breaking any large lumps of mineral present to obtain a product substantially all of which consists of pieces not larger than 20 mm;

(ii) introducing into a grinding chamber which has an internal, rotatable impeller driven by an electric motor, water, a dispersing agent and the product of step (i);

(iii) agitating the contents of said grinding chamber; and (iv) continuously withdrawing from the grinding chamber a slurry of comminuted mineral;

wherein there is present in said grinding chamber during the agitation of said slurry no particulate solid material other than said mineral; and wherein the rates of introducing said water, said dispersing agent and said product of step (i) into said grinding chamber and the rate of withdrawing the slurry of comminuted mineral from the grinding chamber are such that the slurry of comminuted mineral withdrawn from the grinding chamber contains at least 50% by weight of solids, the volume of material in the grinding chamber is maintained substantially constant, and the power consumed by the electric motor driving said impeller is maintained between upper and lower limits.

The method of the invention will now be exemplified by reference to its application to the comminution of calcium carbonate minerals.

In step (i) of the method separate batches of calcium carbonate mineral may be crushed to different extents, or the particle size distribution of the crushed mineral may be modified by sieving, to give products which can be combined together in any proportion to give a blend which has a particularly advantageous particle size distribution.

In step (ii) of the method the dispersing agent may be a water-soluble salt of a polysilicic acid, or a water-soluble organic polymeric material, for example a water soluble salt of a poly(acrylic acid) or of a poly (methacrylic acid) having a number average molecular weight not greater than 5,000 or a copolymer of the type disclosed in British Patent Specification No. 1,414,964. The amount of dispersing agent used will generally be in the range of from 0.1% to 0.6% by weight, based on the dry weight of calcium carbonate mineral.

In step (iii) of the method, the agitation of the slurry is carried out under conditions such that the amount of energy dissipated in the slurry is preferably at least 30 horsepower hours per ton of dry calcium carbonate but not normally more than 250 horsepower hours per ton of dry calcium carbonate (80–650 $kJkg^{-1}$).

In step (iv) of the method, the comminuted calcium carbonate mineral is advantageously withdrawn from the grinding chamber of the attrition grinding mill through a sieve of appropriate aperture size. Advantageously, the attrition grinding mill is of the type described in U.S. Pat. No. 3,995,817 and the outlet means is fitted with a sieve which retains coarse particles but allows a slurry of fine particles to pass therethrough. In one embodiment of such an attrition grinding mill the aperture size of the sieve is conveniently in the range from 0.1 to 0.5 mm (i.e. between No. 150 mesh and No. 30 mesh British Standard Sieve).

In steps (ii), (iii) and (iv) of the method the rates at which water, dispersing agent and calcium carbonate mineral are introduced into the grinding chamber of the attrition grinding mill in step (ii) and the rate at which the slurry of comminuted calcium carbonate is withdrawn from the grinding chamber in step (iv) are preferably such that the solids content of the slurry withdrawn from the grinding chamber is at least 60% by weight but not greater than 80% by weight, the volume of material in the grinding chamber is maintained substantially constant, and the power consumed by the electric motor driving the impeller is maintained between predetermined upper and lower limits, the upper limit being such that the current drawn by the motor at a given voltage is from 70 to 98%, preferably from 90 to 97%, of full-load current and the difference between the upper and lower limit is from 5 to 50%, preferably 20 to 30%, of the upper limit. These requirements have been found to be necessary in order to maintain the weight throughout of solids at or near the capacity of the attrition grinding mill.

After step (iv) of the method, the slurry of comminuted calcium carbonate mineral may be further comminuted by agitation in a second attrition grinding mill of the type described as being suitable for use in step (ii) and (iii) of the method, the grinding chamber this time being charged with a particulate grinding medium consisting of particles having sizes in the range from about 0.15 mm to about 2 mm. The amounts of particulate grinding medium and slurry of calcium carbonate mineral are preferably such that the volume ratio of granular grinding medium to slurry in the grinding chamber is in the range 0.5:1 to 1.5:1, preferably in the range 0.9:1 to 1.1:1. An especially suitable grinding medium is silica sand.

BRIEF DESCRIPTION OF THE DRAWINGS

Embodiments of the invention will now be described, by way of example and with reference to the accompanying drawings in which.

DESCRIPTION OF THE PREFERRED EMBODIMENTS

Figure 1:
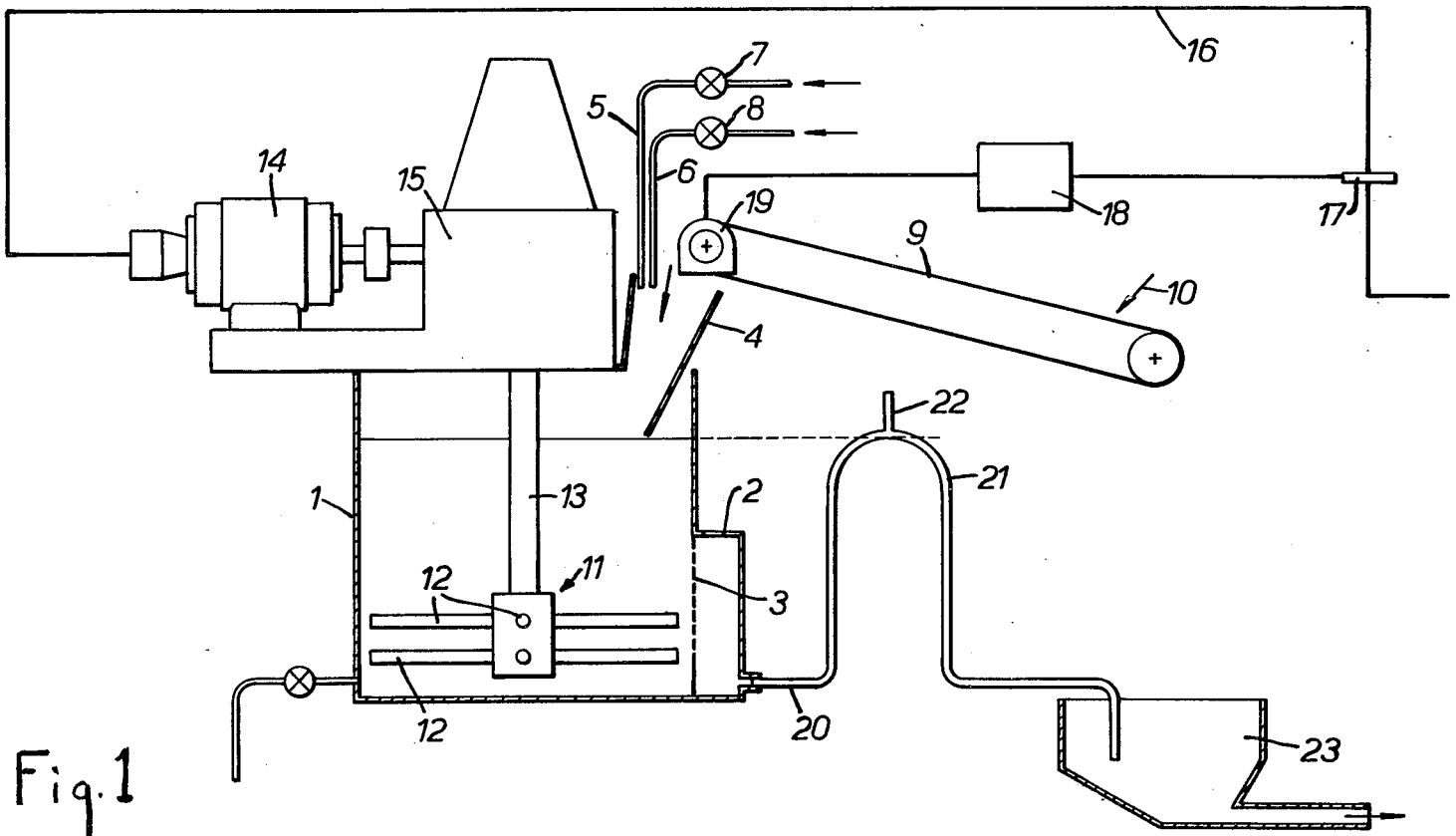
FIG. 1 is a diagrammatic illustration of an apparatus suitable for carrying out one embodiment of the method of the invention.

Referring to FIG. 1, an attrition grinding mill includes a grinding chamber 1 which is octagonal in cross section and has a width which is a little smaller than its height. At its lower end it is provided with an outlet box 2 with a sieve 3 which permits a slurry containing particles which have been ground sufficiently to pass therethrough while retaining particles which have not been sufficiently finely ground. A feed chute 4 is provided to enable solid particulate calcium carbonate mineral to be fed to the grinding chamber 1. Conduits 5 and 6, provided with control valves 7 and 8 respectively, serve to introduce water and dispersing agent respectively at controlled rates into the grinding chamber 1. The calcium carbonate mineral to be ground is deposited on an endless belt conveyor 9 at the position indicated by the arrow 10 and is conveyed to the grinding chamber and discharged thereinto via the feed chute 4.

The grinding chamber is provided with an impeller 11 which comprises eight straight bars 12, each of circular cross-section, mounted on a central vertical shaft 13 which is driven by an electric motor 14 through a gear box 15. Electric power is supplied to the motor through a cable 16 and the electric current flowing in this cable, i.e. the current drawn by the electric motor, is sensed by a measuring unit 17 which transmits a signal proportional to the current drawn by the electric motor 14 to a control unit 18 which controls an electric motor 19 which drives the endless belt conveyor 9. When the current drawn by the electric motor 14 exceeds a certain first predetermined, upper limit the motor 19 is de-energized by the control unit 18 and the supply of calcium carbonate mineral to the grinding vessel is halted. When the current drawn by the electric motor 14 falls again below a second predetermined, lower limit the control unit 18 re-energizes the motor 19 and the supply of calcium carbonate mineral is restarted.

The control unit 18 is provided with a first preset potentiometer which determines the upper limit of the current drawn by the motor 14 at which the motor 19 is de-energized and a second preset potentiometer which determines what the difference between the upper and lower limits shall be. The level of liquid in the grinding vessel is maintained constant by connecting to the lowest point of the outlet box 2 a conduit 20 which is provided with an inverted U-shaped portion 21, the highest point of the inverted U being at the desired liquid level. A vent 22 is provided at this point as a siphon breaker. Ground slurry passes through conduit 20 to a product sump 23.

Figure 2:
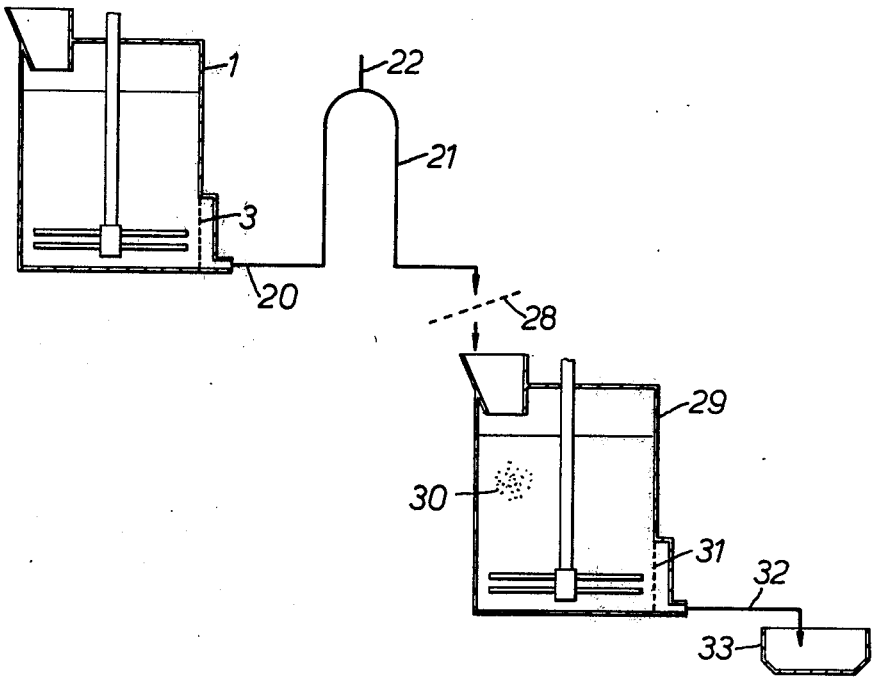
FIG. 2 is a diagrammatic illustration of an apparatus suitable for carrying out a second embodiment of the method of the invention.

Referring now to FIG. 2, there is shown apparatus whereby material which has been comminuted in accordance with the process described above with reference to FIG. 1 can be further comminuted. Material which has been ground in grinding chamber 1 passes through screen 3 and is discharged through conduit 20, having an inverted U-shaped portion 21 and a vent 22, to a sieve 28 having an aperture of 0.120 mm. Slurry passing through the sieve enters the grinding chamber 29 of second attrition grinding mill containing silica sand 30 as the grinding medium. The silica sand 30 consists of particles ranging in size from 0.15 mm to 2.0 mm, and the amounts of particulate grinding medium and slurry charged to the grinding chamber 29 are such that the volume ratio of granular grinding medium to slurry in the grinding chamber is in the range of from 0–5:1 to 1–5:1. Finely ground material passes through a sieve 31 and is discharged through a conduit 32 to product sump 33.

The invention is further illustrated by the following Examples.

EXAMPLE 1

Large lumps of Carrara marble were broken by conventional crushing equipment and the crushed material had the particle size distribution shown in Table 1 below:

TABLE 1

| Size range:mm | % by weight in size range |
|---|---|
| −12 + 6 | 61.8 |
| −6 + 4 | 21.9 |
| −4 + 2 | 13.5 |
| −2 + 1 | 1.0 |
| −1 | 1.8 |
| | 100.0 |

The crushed material was fed into the grinding chamber of an attrition grinding mill of the type shown in the accompanying drawing at an average rate of 3.72 metric tons per hour, together with water at the rate of 2,260 liters per hour and a sodium polyacrylate dispersing agent having a number average molecular weight of 1650 at the rate of 0.19% by weight, based on the weight of dry solids. The contents of the grinding chamber were agitated by means of the impeller to form a slurry. No additional grinding medium was introduced to the grinding chamber and there were dissipated in the slurry 65 horsepower hours of energy per ton of dry calcium carbonate (175 $kJkg^{-1}$). The total solids content of the grinding chamber during operation was approximately 86 to 89%. The full load rating of the electric motor driving the impeller was 375 amps, and the rate at which the solids was fed into the grinding chamber was controlled so that the maximum current drawn by the motor was 360 amps and the minimum current drawn by the motor was 280 amps. A slurry of finely ground particles passed through the sieve and was sampled at intervals, and a bulk sample representative of the total output of ground material was prepared. The product consisted of a deflocculated slurry containing 62.2% by weight of ground calcium carbonate having a particle size distribution such that 26% by weight consisted of particles having an equivalent spherical diameter smaller than 2 microns, 39% by weight consisted of particles having an equivalent spherical diameter larger than 10 microns and 2.3% by weight consisted of particles which were retained on a No. 300 mesh B.S. sieve.

The product slurry was passed through a sieve having an aperture of 0.120 mm to the grinding chamber of a second attrition grinding mill identical to the first but containing as grinding medium 2.5 metric tons of silica sand consisting of particles ranging in size from 0.5 to 1.0 mm, the quantity of sand being such that the volume occupied by the sand was approximtely equal to the volume occupied by the slurry in the grinding chamber. Additional sodium polyacrylate dispersing agent was mixed with the slurry to raise the total amount of dispersing agent to 0.45% by weight based on the weight of dry calcium carbonate. The slurry was passed continuously through the grinding chamber, the contents being agitated by means of the impeller for a total time of 5 hours 16 minutes. The slurry of finely ground particles passing through the sieve was sampled at intervals and a bulk sample representative of the total output of ground material was prepared. The product consisted of a deflocculated suspension containing 70.2% by weight of ground calcium carbonate having a particle size distribution such that 94% by weight consisted of particles having an equivalent spherical diameter smaller than 2 microns and 2% by weight consisted of particles having an equivalent spherical diameter larger than 10 microns. The autogenous grinding process according to the invention can therefore be seen to provide a suitable preliminary step to a conventional attrition grinding step for producing ultra-fine natural calcium carbonate.

By way of comparison a sample of the crushed marble which was used as the feed material in the method described above was ground to approximately the same particle size distribution (namely 28% by weight having an equivalent spherical diameter smaller than 2 microns, 42% by weight having an equivalent spherical diameter larger than 10 microns and 1.3% by weight retained on a No. 300 mesh sieve B.S.) in a conventional pebble mill having a grinding charge of flint pebbles. The pebble mill could grind a batch comprising 11 metric tons of crushed marble but the time taken to reduce it to the desired degree of fineness was found to be 6 hours with a time of 1 hour for discharging and reloading. The average rate of production was therefore 1.57 metric tons of dry ground calcium carbonate per hour compared with 3.72 metric tons per hour produced by the process of the invention. One attrition grinding mill used in accordance with the process of the invention is therefore equivalent to two or three pebble mills used in accordance with a conventional process.

EXAMPLE 2

Large lumps of a white limestone were broken by conventional crushing equipment and the crushed material further comminuted in a hammer mill to give a material having the particle size distribution shown in Table 2 below:

TABLE 2

| Size Range (mm) | % by weight in size range |
|---|---|
| +12 | 7.9 |
| −12 + 6 | 35.1 |
| −6 + 4 | 11.6 |
| −4 + 2 | 19.9 |
| −2 + 1 | 10.3 |
| −1 | 15.2 |
| | 100.0 |

The hammer milled material was fed into the grinding chamber of the attrition grinding mill shown in the accompanying drawing together with water at the rate of 948 liters per hour and the sodium polyacrylate dispersing agent used in Example 1 at the rate of 0.45% by weight, based on the weight of dry solids, to form a slurry containing about 85–89% by weight of solids. The average throughout rate of the milled material was found to be 1.84 metric tons per hour, but the endless belt conveyor 9 was operated at a speed such that the rate of delivery of the milled material to the feed chute 4 was greater than 1.84 metric tons per hour so that the current drawn by the electric motor 15 could be maintained at about 80% of its full load rating by energizing and de-energizing the conveyor motor 19 by means of the control unit 18. The electric motor driving the impeller had a full load rating of 375 amps and the rate of delivery of the milled material was controlled so that the maximum current drawn by the motor was 340 amps and the minimum current drawn by the motor was 260 amps. The contents of the grinding chamber 1 were agitated by means of the impeller. No additional grinding medium was introduced, and there were dissipated in the slurry 135 horsepower hours of energy per ton of dry calcium carbonate (357 $kJkg^{-1}$). The slurry of finely ground particles passing through the screen 3, which had an aperture size of 0.250 mm, was sampled at intervals and a bulk sample representative of the total output of ground material was prepared. The product consisted of a deflocculated slurry containing 65.7% by weight of ground calcium carbonate having a particle size distribution such that 39% by weight consisted of particles having an equivalent spherical diameter smaller than 2 microns, 15% by weight consisted of particles having an equivalent spherical diameter larger than 10 microns and 0.91% by weight consisted of particles which were retained on a No. 300 mesh British Standard sieve.

The product was suitable for further grinding to form an ultra-fine calcium carbonate by the process described in Example 1 except that it was unnecessary to add a further quantity of the dispersing agent since sufficient had been added in the first attrition grinding stage.

The results show that, although the throughput rate is lower and the energy consumption higher than in the case of marble, the process of the invention is suitable for comminuting a hard calcium carbonate material such as limestone.

I claim:

1. A method for comminuting a mineral using essentially an autogenous grinding technique, which method comprises the following steps:

(i) breaking any large lumps of mineral present to obtain a product substantially all of which consists of pieces not larger than 20 mm;

(ii) introducing into a grinding chamber which has an internal, rotatable impeller driven by an electric motor, water, a dispersing agent and the product of step (i) to form slurry;

(iii) agitating the slurry in said grinding chamber;

(iv) continuously withdrawing from the grinding chamber a slurry of comminuted mineral;

(v) maintaining the volume of slurry in said grinding chamber substantially constant; and (vi) maintaining the power consumed by the electric motor between upper and lower limits by controlling the amount of the product of step (i) introduced into the grinding chamber;

wherein there is present in said grinding chamber during the agitation of said slurry no particulate solid material other than that added as the product of step (i); and wherein the rates of introducing said water, said dispersing agent and said product of step (i) into said grinding chamber and the rate of withdrawing the slurry of comminuted mineral from the grinding chamber are such that the slurry of comminuted mineral withdrawn from the grinding chamber contains at least 50% by weight of solids.

2. A method according to claim 1, wherein said mineral is a calcium carbonate mineral.

3. A method according to claim 2, wherein in step (iii) the agitation of said slurry is carried out under conditions such that the amount of energy dissipated in the slurry is at least 30 horsepower hours per ton of dry calcium carbonate but not more than 250 horsepower hours per ton of dry calcium carbonate.

4. A method according to claim 2, wherein the rates at which water, dispersing agent and calcium carbonate mineral are introduced into the grinding chamber of the attrition grinding mill in step (ii) and the rate at which the slurry of comminuted calcium carbonate is withdrawn from the grinding chamber in step (iv) are such that the solids content of the slurry withdrawn from the grinding chamber is at least 60% by weight but not greater than 80% by weight.

5. A method according to claim 1, wherein said upper limit is such that the current drawn by the electric motor at a given volage is from 70 to 98% of full-load current and the difference between the upper and lower limits is from 5 to 50% of the upper limit.

6. A method according to claim 1, wherein after step (iv) of the method, the slurry of comminuted calcium carbonate mineral is further comminuted by agitation in a second grinding chamber containing an internal, rotatable impeller, wherein the second grinding chamber is charged with a particulate grinding medium consisting of particles having sizes in the range from about 0.15 mm to about 2 mm, and the amounts of particulate grinding medium and slurry of calcium carbonate mineral in said second grinding chamber are such that the volume ratio of granular grinding medium to slurry is in the range 0.5:1 to 1.5:1.

* * * * *